US011064812B2

(12) United States Patent
Thornburg et al.

(10) Patent No.: US 11,064,812 B2
(45) Date of Patent: Jul. 20, 2021

(54) VENTED BEDDING SYSTEM AND METHOD OF USE

(71) Applicants: Charles Thornburg, North Richland Hills, TX (US); Natali Thornburg, North Richland Hills, TX (US)

(72) Inventors: Charles Thornburg, North Richland Hills, TX (US); Natali Thornburg, North Richland Hills, TX (US)

( * ) Notice: Subject to any disclaimer, the term of this patent is extended or adjusted under 35 U.S.C. 154(b) by 252 days.

(21) Appl. No.: 16/059,864

(22) Filed: Aug. 9, 2018

(65) Prior Publication Data

US 2018/0344043 A1 Dec. 6, 2018

(51) Int. Cl.
*A47C 21/04* (2006.01)
*A47D 9/00* (2006.01)

(52) U.S. Cl.
CPC ..... *A47C 21/044* (2013.01); *A47D 9/00* (2013.01)

(58) Field of Classification Search
CPC ..... A47C 21/044; A47C 21/042; A47D 9/00; A47G 9/0215
See application file for complete search history.

(56) References Cited

U.S. PATENT DOCUMENTS 2,400,790 A * 5/1946 Tolen ..... A47D 15/001 5/284
3,529,310 A * 9/1970 Olmo ..... A47C 7/74 5/423
7,945,979 B1 * 5/2011 Lin ..... A61H 9/0071 5/726
8,181,290 B2 * 5/2012 Brykalski ..... A61G 7/05 5/423
2009/0064411 A1 * 3/2009 Marquette ..... B60H 1/00742 5/423
2010/0287701 A1 * 11/2010 Frias ..... A47C 27/082 5/423
2013/0212808 A1 * 8/2013 Lachenbruch ..... A47C 27/00 5/691
2015/0208814 A1 * 7/2015 Alletto, Jr. ..... A47C 27/00 5/423
2016/0038101 A1 * 2/2016 Benner ..... A47C 21/044 5/421

* cited by examiner

*Primary Examiner* — Robert G Santos
*Assistant Examiner* — Alison N Labarge
(74) *Attorney, Agent, or Firm* — Leavitt Eldredge Law Firm

(57) ABSTRACT

A bed system includes a ventilated bed with a thickness and a breathable material configured to enable airflow therethrough; a support structure having a plurality of hollow elongated arms integral with each other, each of the plurality of hollow arms having openings in gaseous communication with an airflow channel disposed within the plurality of hollow elongated arms; and a plurality of fans in gaseous communication with the airflow channels. The airflow is directed from the plurality of fans through the airflow channel and plurality of hollow elongated arms, and through the thickness of the ventilated bed.

2 Claims, 8 Drawing Sheets

VENTED BEDDING SYSTEM AND METHOD OF USE

BACKGROUND

1. Field of the Invention

The present invention relates generally to beds, and more specifically, to system having a bed with a vent assembly.

2. Description of Related Art

Infant bedding is well known in the art. For example, FIG. 1 depicts an oblique view of an infant bed 101 having a support structure 103 configured to carry a mattress 105 therein an opening. During use, the infant is placed on the mattress and confined within the area created by the opening of structure 103. The support structure 103 is typically elevated at a height relative to the ground surface via one or more legs 107.

Although effective in most applications of use, it should be understood that an infant placed therein the bed 101 will have a tendency to overheat with increased ambient temperatures. Accordingly, there is a need to provide means to cool the infant during use to decrease overheating and/or uncomfortable sleeping conditions.

Although great strides have been made in the area of bedding, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
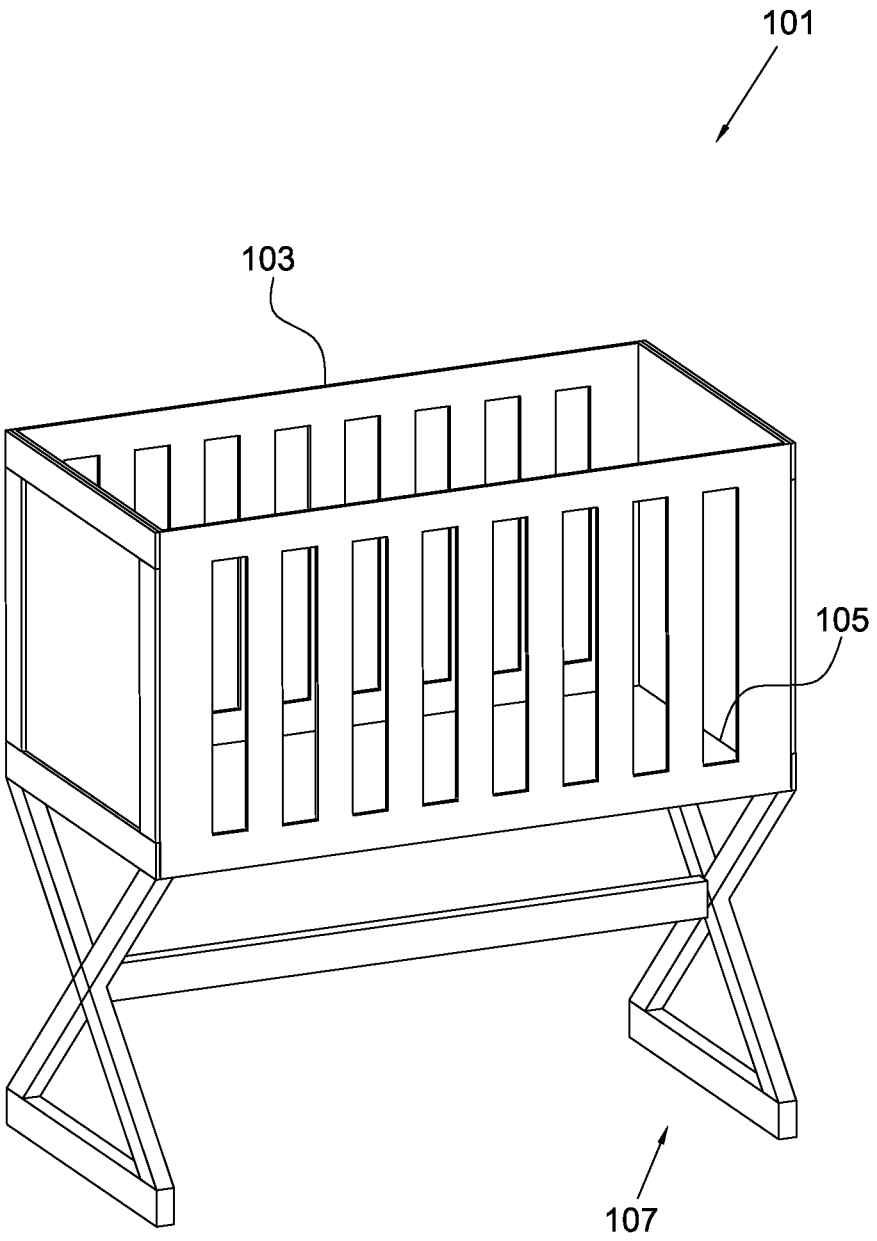
FIG. 1 (PRIOR ART)
FIG. 1 is a side view of an oblique view of a conventional bed.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional types of infant bedding, whether stationary or portable. Specifically, the system of the present application is configured to provide rapid and effective means to provide comfort to the infant carried within the bed via a ventilation system. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-6 depict various embodiments of a bedding system 201 in accordance with a preferred embodiment of the present application. It will be appreciated that system 201 overcomes one of more of the above-listed problems commonly associated with the conventional infant bedding.

In one or more embodiments of system 201, the system is provided with a frame 203 configured to elevate a bed and ventilation assembly 205 at a height relative to the ground surface along with holding a basket 207 for use.

In the contemplated embodiment, frame 203 includes a plurality of vertical support 301configured to engage with one or more horizontal members 303, 305, 307, along with members 309 and 311, as depicted in the drawings. The frame is provided with a plurality of horizontal members 315 spaced at different heights relative to each other and having a plurality of fasteners 317 secured to an outer surface for removably engaging with the bed and ventilation assembly 205 and/or the basket 207. The frame is further supported with an optional member 319. During use, the members provide means to secure the bed and ventilation assembly 205 and basket 207 to the frame. The frame 203 is further provided with a plurality of wheels configured to enable movement of the frame during transport.

Figure 4:
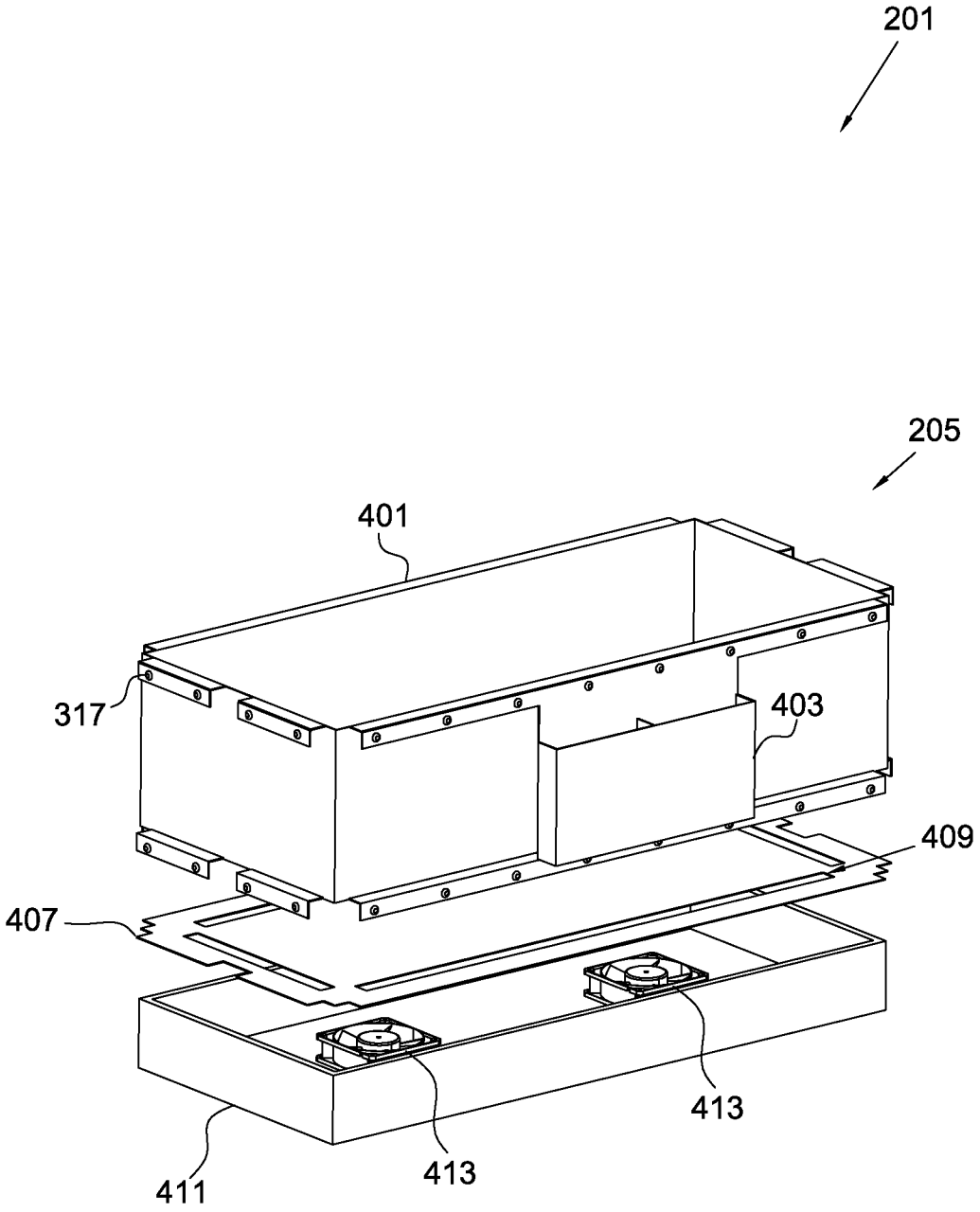
FIG. 4 is an exploded view of the bed and vent assembly of the bed of FIG. 2.
Figure 5:
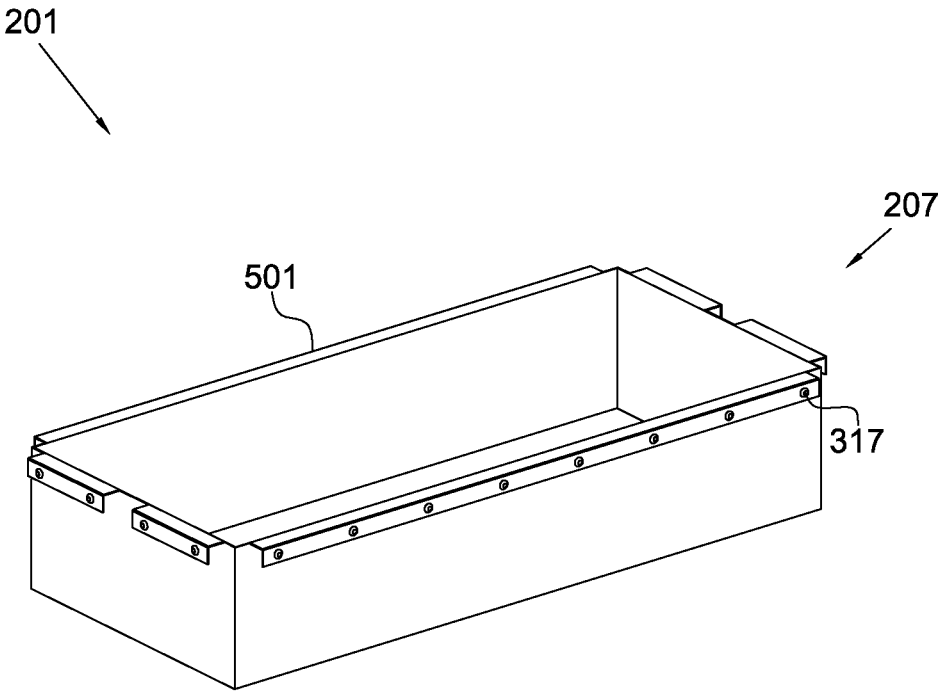
FIG. 5 is an oblique view of the bed of FIG. 2.

Referring specifically to FIG. 4, an exploded view of the bed and ventilation assembly 205 is shown in further detail. In the contemplated embodiment, the assembly 205 includes a bed support 401 having one or more pockets 403 secured thereto. The bed support 401 includes one or more fasteners configured to removably engage with the fasteners 317 of the horizontal members of the frame. In the contemplated embodiment, the bed support 401 could include a mattress carried therein or configured to enable the infant to be positioned on a bottom surface of the support 401.

The assembly 205 is further provided with a ventilation lid 407 having a plurality of openings 409 configured to allow to pass therethrough. The lid is configured to engage with a box 411 configured to store one or more fans 413 therein. During use, the fans 413 force air through the openings 407 to the bed support 401. In one embodiment, the bed support could be composed of a breathable material, which in turn allows the air the pass therethrough. In the contemplated embodiment, the box 411 is spaced at a fixed position relative to the bed support; however, it is also contemplated having the box adjustable relative to the bed support.

Figure 2:
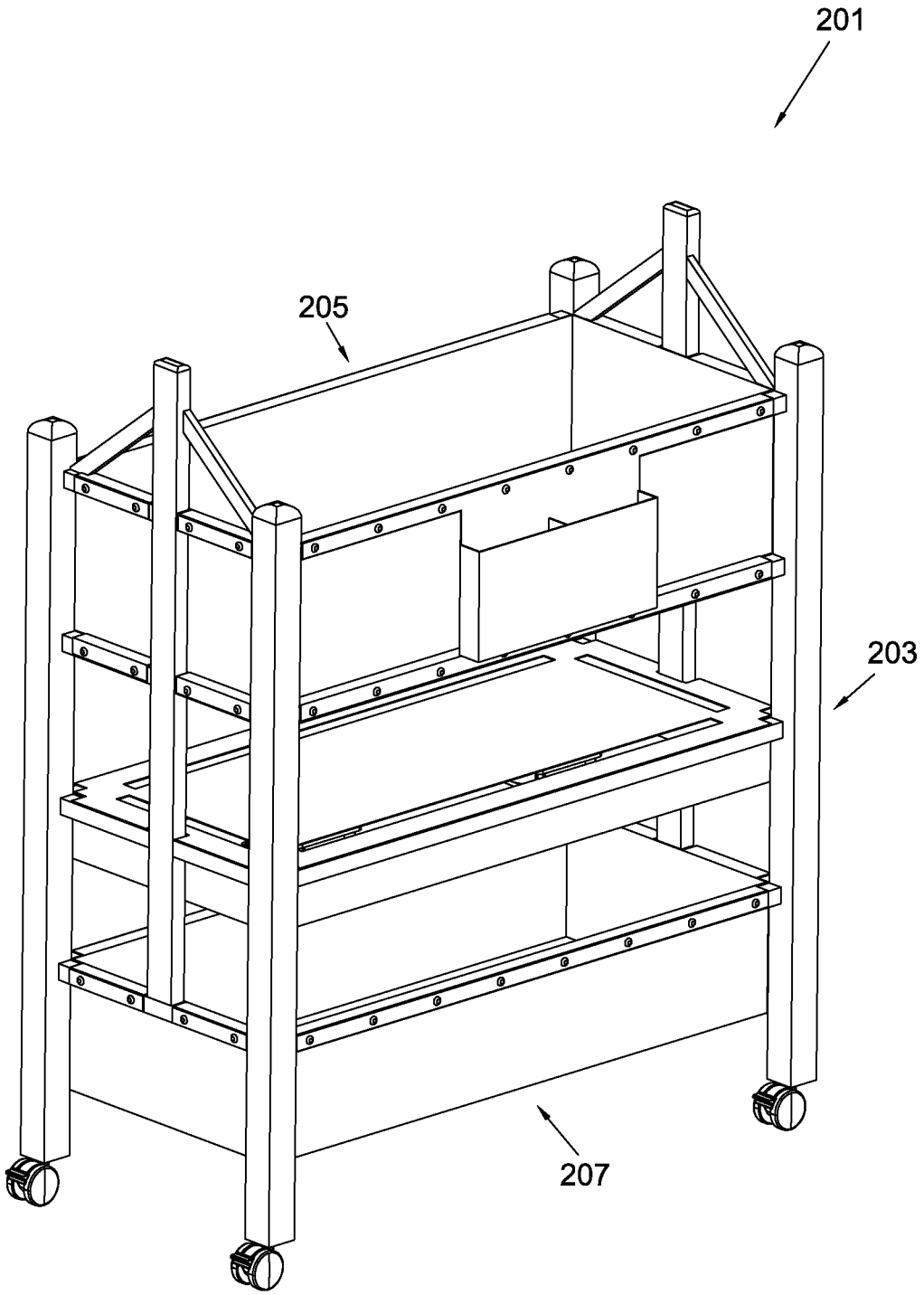
FIG. 2 is an oblique view of the bed in accordance with a preferred embodiment of the present invention.
Figure 3:
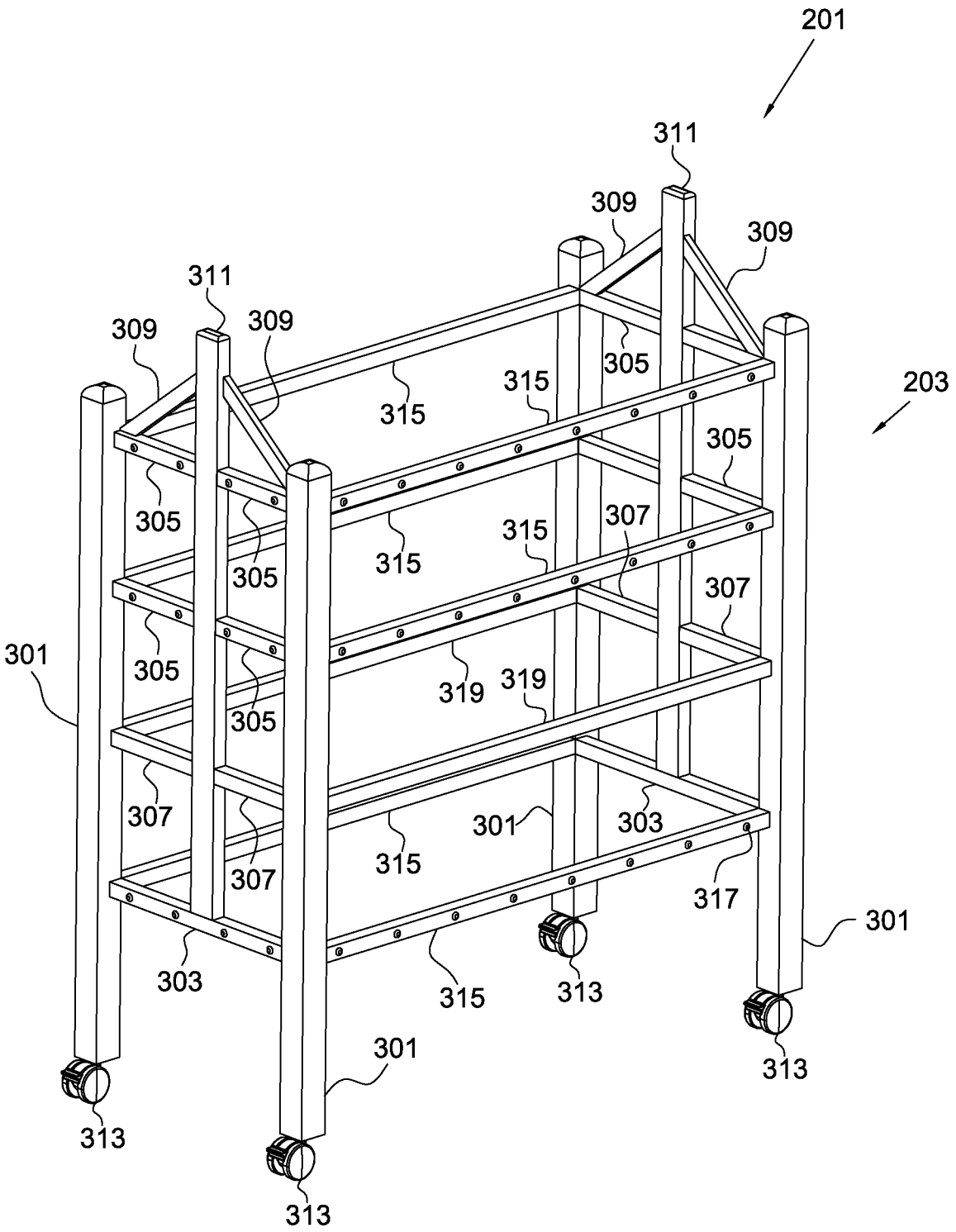
FIG. 3 is an oblique view of the support structure of the bed of FIG. 2.
Figure 6:
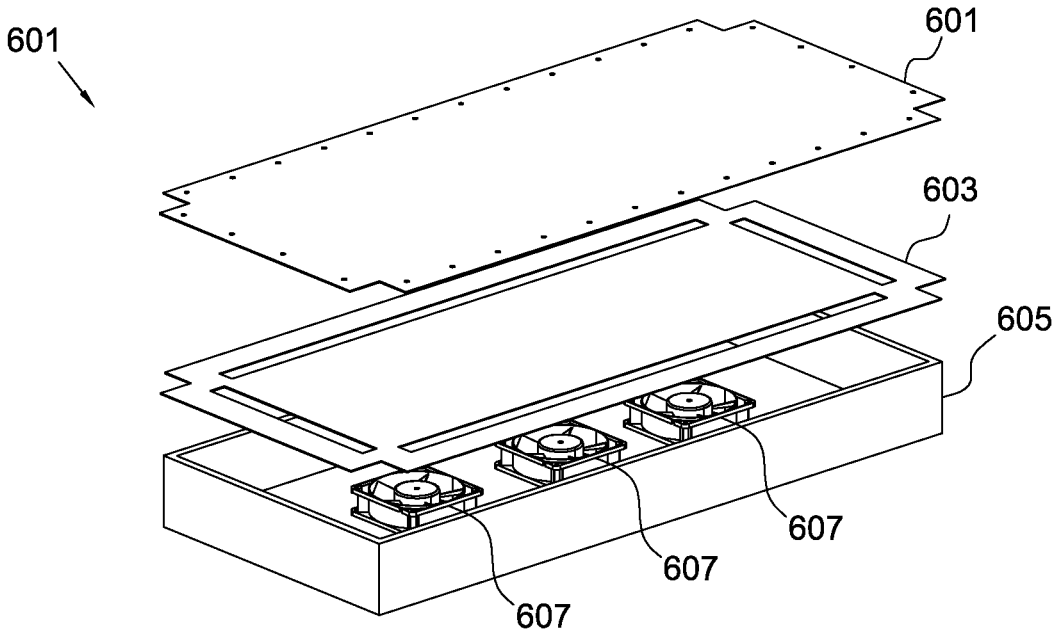
FIG. 6 is an oblique view of the vent assembly of the bed of FIG. 2.

FIG. 6 illustrates another contemplated embodiments wherein a mattress 601 could be spaced directly above the openings of the lid 603 which in turn is provided air via one or more fans 607 disposed within box 605. Accordingly, it is contemplated having a mattress 601 configured to be in direct gaseous communication with the openings and/or carried at a spaced distance from the fans, as shown in FIG. 2.

One of the unique features believed characteristic of the present application is the ability to cool the bed support and/or mattress via a plurality of fans, which are either spaced apart from the mattress or in direct communication. Alternative embodiments are shown in the remaining figures.

Referring now to FIGS. 7-11, alternative embodiments are now shown. It will be appreciated that the alternative embodiments incorporate one or more of the features discussed above and incorporate the same although not shown.

Figure 7:
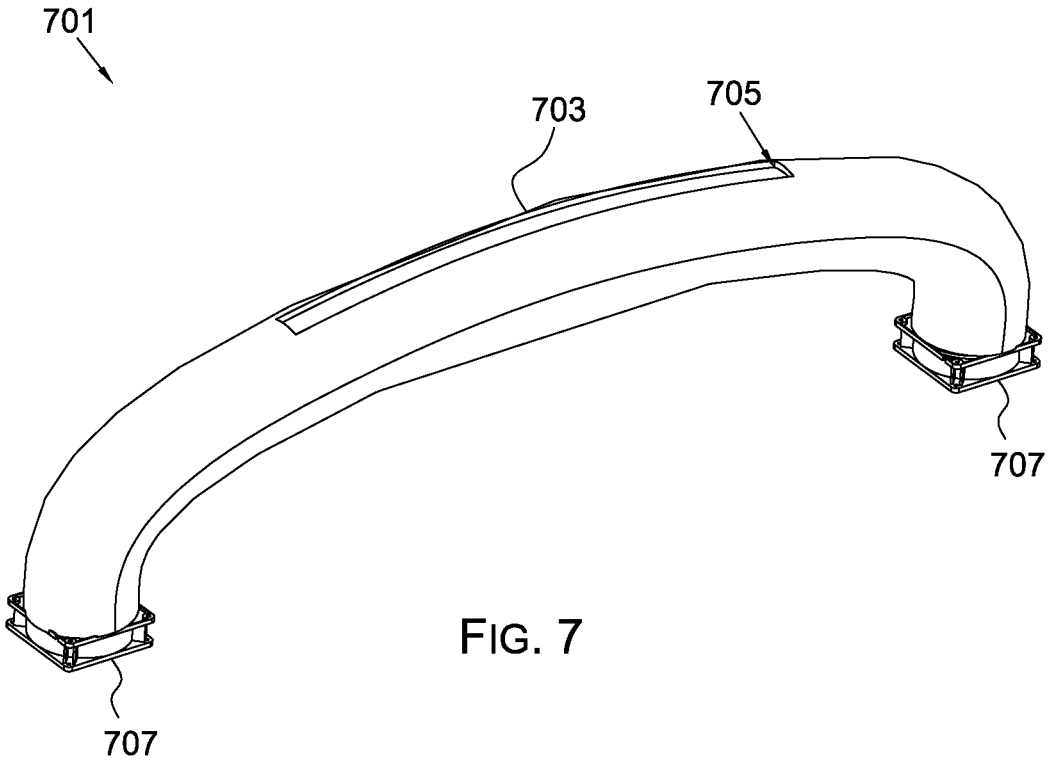
FIG. 7 is an oblique view of a vent assembly for a bed in accordance with an alternative embodiment of the present invention.
Figure 8:
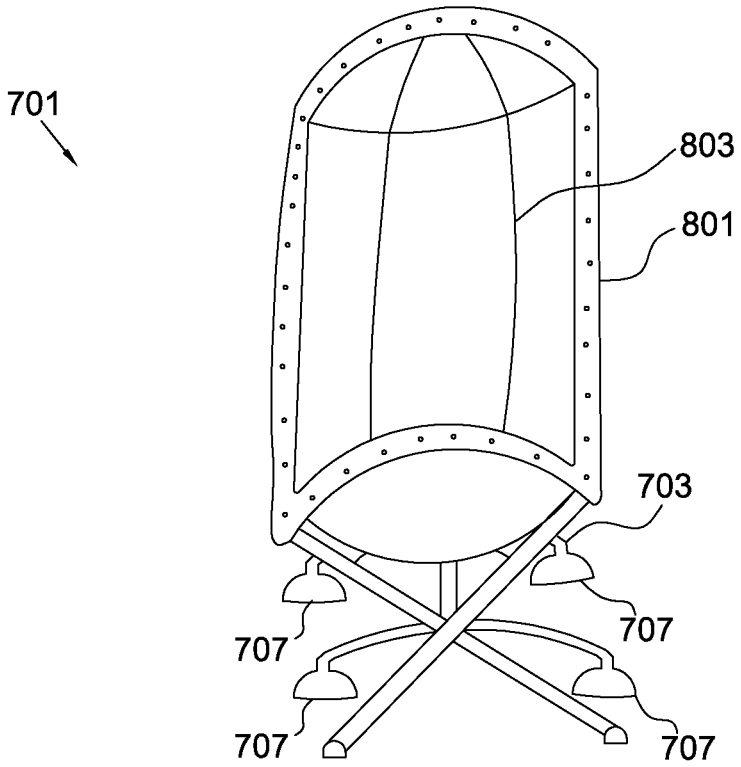
FIG. 8 is an oblique view of a bed in accordance with an alternative embodiment of the present invention.

In FIGS. 7 and 8, oblique views of a system 701 is shown, wherein the system includes a detachable ventilation assembly having a hollow body 703 with openings 705 in communication with one or more fans 707. During assembly, the body 703 is configured to removably engage with a support structure 801 configured to support a bed structure 803 thereto. As depicted, the ventilation assembly can be supported at various locations along the support structure.

Figure 9:
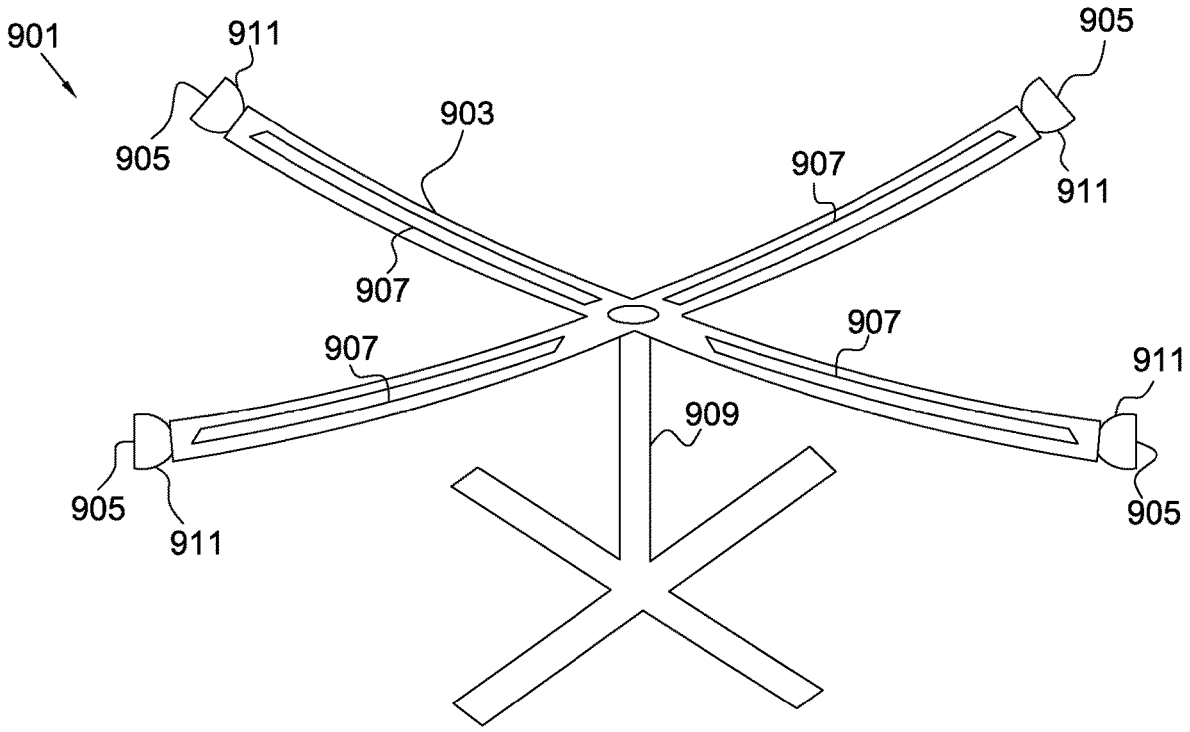
FIG. 9 is an oblique view of a bed stand in accordance with an alternative embodiment of the present invention.

In FIG. 9, a support structure 901 is shown having a body with a plurality of hollow arms 903 with a plurality of fans 911 the direct air from a front surface 905 through the hollow arm and out through the openings 907. The openings 907 are configured to direct airflow to the bed configured to rest on the plurality of arms. The arms 903 are secured in position via a vertical member 909. During use, the support structure 901 is configured to secure a bed structure at a height relative to the ground surface as shown in the previous embodiments discussed above. Accordingly, the features of support structure 901 ate utilized with the features of one or more of the features of the previously discussed above.

Figure 10:
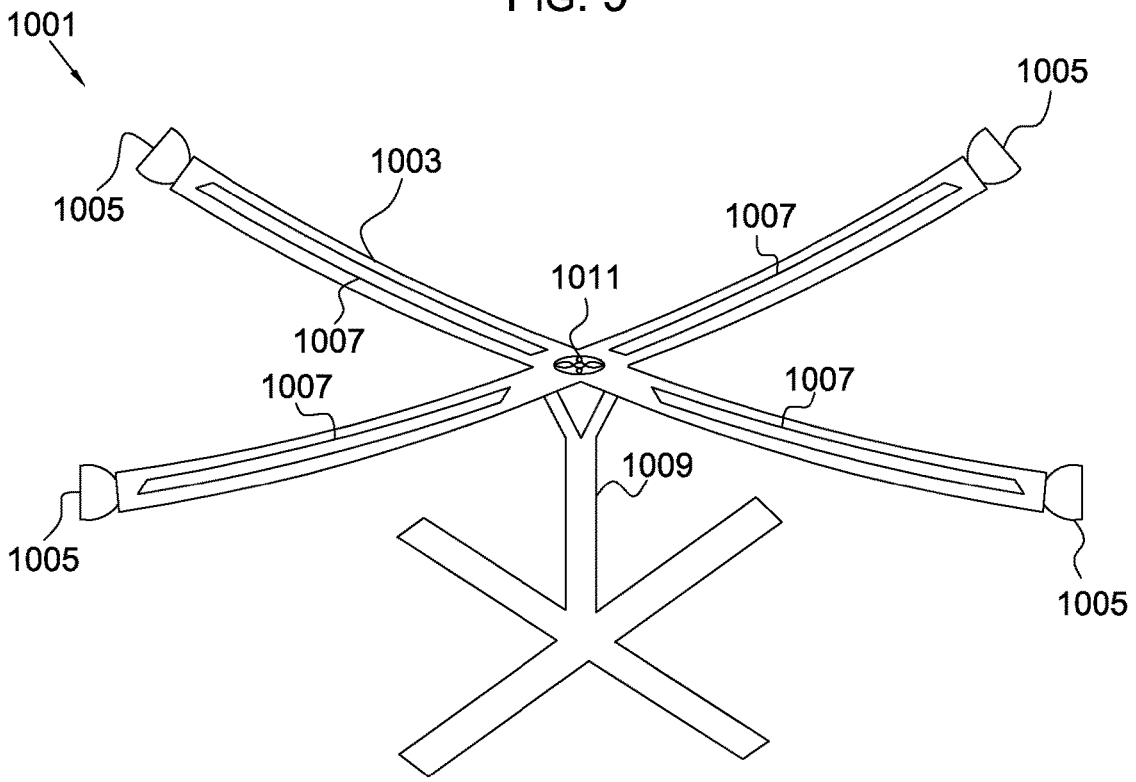
FIG. 10 is an oblique view of a bed stand in accordance with an alternative embodiment of the present invention.

In FIG. 10, a support structure 1001 is shown having a body 1003 with a plurality of arms extending therefrom and a plurality of opening ports 1005 in gaseous communication with a central fan 1011 configured to direct air through the arms out the openings 1007. The structure 1001 is further provided with a vertical member 909. In both FIGS. 9 and 10, a bed structure 1101 is configurated to removably engage with the arms of each embodiment.

Figure 11:
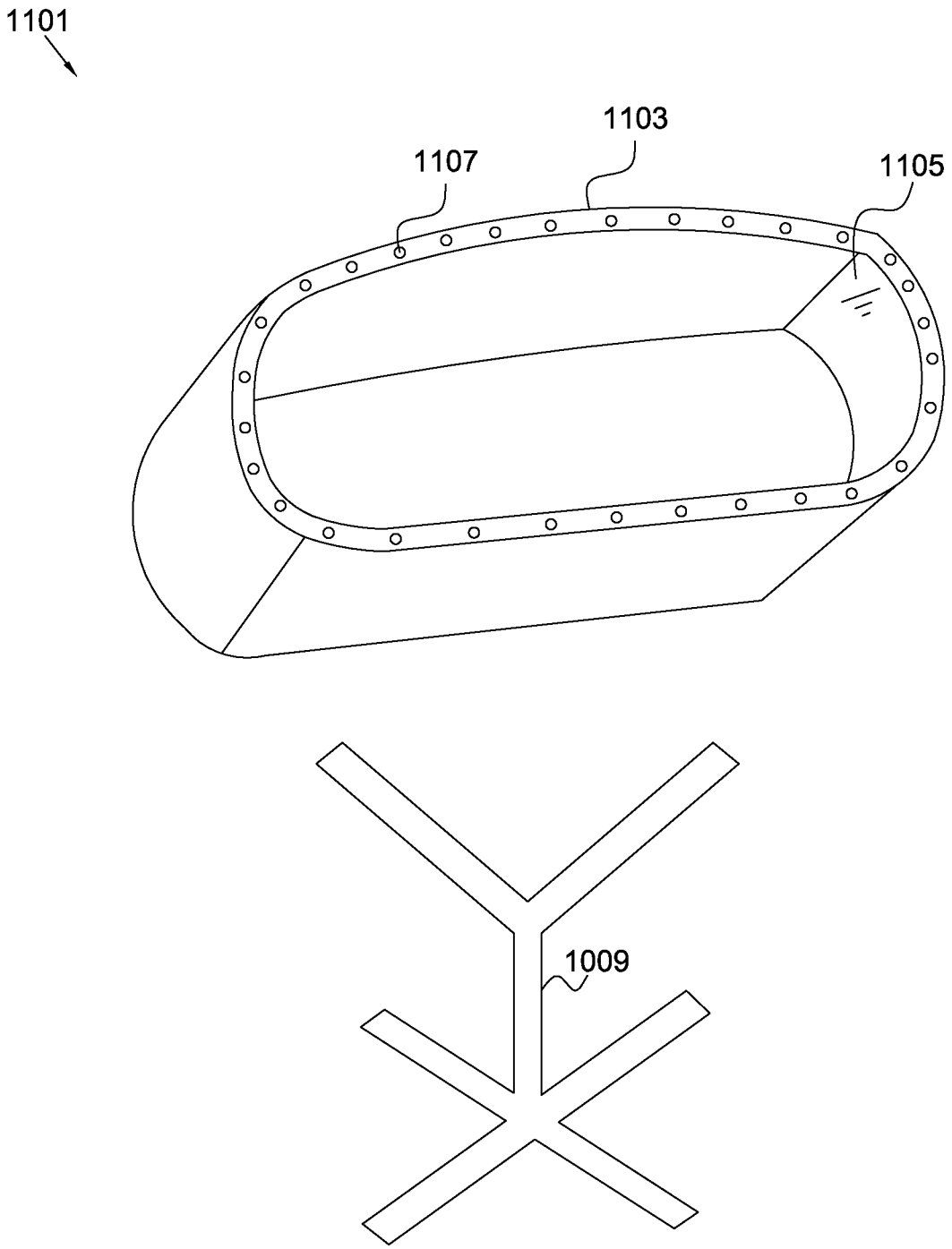
FIG. 11 is an oblique view of a bed stand in accordance with an alternative embodiment of the present invention.

In FIG. 11, an alternative embodiment is shown. System 1101 depicts an oblique view of the bed support where the fan 1105 is disposed within the body 1103 of the support and configured to channel air through one or more channels 1107 disposed within the thickness of the body.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bed system, comprising:

a ventilated bed having:

a thickness; and a breathable material configured to enable airflow therethrough;

a support structure, having:

a plurality of hollow elongated arms integral with each other, each of the plurality of hollow arms having openings in gaseous communication with an airflow channel disposed within the plurality of hollow elongated arms, the plurality of hollow elongated arms integral with each other at a common joint, the plurality of arms extending radially from the common joint and configured to removably secure to the ventilation bed;

a stand secured to and extending from the common joint, the stand is configured to elevate the plurality of hollow elongated arms at a height relative to a ground surface; and a plurality of fans in gaseous communication with the airflow channels, the plurality of fans are positioned at a proximal end of each of the plurality of hollow elongated arms, the plurality of fans are configured to direct air through the airflow channels;

wherein the ventilation bed is removably attached to the support structure;

wherein airflow is directed from the plurality of fans through the airflow channel and plurality of hollow elongated arms, and through the thickness of the ventilated bed; and wherein the ventilated bed is configured to rest on the plurality of hollow elongated arms.

2. A method, comprising:

providing the bed system of claim 1;

channeling air through the plurality of hollow elongated arms via the plurality of fans.

* * * * *